United States Patent [19]

Forestier

[11] Patent Number: 4,494,909

[45] Date of Patent: Jan. 22, 1985

[54] DAMPING DEVICE FOR TURBOJET ENGINE FAN BLADES

[75] Inventor: Alexandre Forestier, Vaux le Penil, France

[73] Assignee: S.N.E.C.M.A., Paris, France

[21] Appl. No.: 446,625

[22] Filed: Dec. 3, 1982

[30] Foreign Application Priority Data

Dec. 3, 1981 [FR] France ..... 81 22622

[51] Int. Cl.[3] ..... F01D 5/10

[52] U.S. Cl. ..... 416/190; 416/193 A; 416/500

[58] Field of Search ..... 416/193 A, 500, 84, 416/135 R, 144–145, 220 R, 190, 196 R

[56] References Cited

U.S. PATENT DOCUMENTS

| | | | |
|---|---|---|---|
| 2,877,980 | 3/1959 | Stalker | 416/193 A |
| 2,936,155 | 5/1960 | Howell et al. | 416/135 X |
| 3,119,595 | 1/1964 | Wilson | 416/193 A |
| 3,612,718 | 10/1971 | Palfreyman et al. | 416/135 |
| 3,905,722 | 9/1975 | Guy et al. | 416/193 A |

FOREIGN PATENT DOCUMENTS

| | | | |
|---|---|---|---|
| 2658345 | 6/1978 | Fed. Rep. of Germany | 416/193 A |
| 1417600 | 10/1965 | France . | |
| 2026212 | 9/1970 | France . | |
| 2376958 | 8/1978 | France . | |
| 667979 | 3/1952 | United Kingdom | 416/193 A |
| 700898 | 12/1953 | United Kingdom | 416/135 |
| 1457417 | 12/1976 | United Kingdom | 416/193 A |
| 1549422 | 8/1979 | United Kingdom | 416/193 A |

*Primary Examiner*—Everette A. Powell, Jr.

*Attorney, Agent, or Firm*—Oblon, Fisher, Spivak, McClelland & Maier

[57] ABSTRACT

A damping device for the turbojet engine fan blades which includes a wedge placed between the platforms of the blades, the shanks of the blades, and the disc. The wedge consists of a hollow, bellows-shaped body fitted with an axial stop member, the body being inflated after mounting so that it takes up all the space between the platforms of the blades, the blade shanks and the teeth of the disc. The invention is used for damping device of turbojet engine blades.

4 Claims, 4 Drawing Figures

DAMPING DEVICE FOR TURBOJET ENGINE FAN BLADES

BACKGROUND OF THE INVENTION

1. Field of the Invention

The present invention concerns a damping device for a turbojet engine fan blades.

2. Description of the Prior Art

In turbojet engine fans, the practice of mounting the blade roots with play in the disc groove, despite the presence of a metal block, is known.

When the fan turns at maximum speed, the blade roots are pressed against the upper wall of the disc's groove by centrifugal force. In contrast, at low speed or when the engine stops, when the centrifugal force becomes insufficient to press the blade against the top of the groove, or even when the fan windmills under the effect of the wind, the blades have play in their groove and produce a characteristic rattle. This bearing of the blade roots in the groove may lead to a wearing away of the protective covering, hammering of the disc teeth, and local corrosion, all of which are defects that are harmful to the life of the disc and may require a costly part to be discarded.

A number of procedures have been proposed to remedy this defect which is common to all fans. In particular, an elastic metal plate has been placed under the root of the blades, or the enclosure under the platform between two blades has been filled with a synthetic foam.

SUMMARY OF THE INVENTION

In order to overcome this drawback of the prior art, the invention utilizes a pneumatic damping device.

According to the present invention, the block consists of a hollow body in the form of a bellows fitted with an axial stopping mechanism, said body being inflated after mounting so that it fills up all the space between blade platforms, blade slits, and disc teeth.

With this system, when the block is inflated it pushes the blade platforms radially upwardly, and its expansion peripherally contributes to holding the blades firmly in place and to absorbing vibrations.

According to another important advantage of the invention, the pneumatic block eliminates virtually all air escape from under the platforms.

BRIEF DESCRIPTION OF THE DRAWINGS

Various other objects, features and attendant advantages of the present invention will be better understood when the following detailed description in connection with the accompanying drawings in which like reference characters designate like or corresponding parts throughout the several views, and wherein.

DETAILED DESCRIPTION OF THE PREFERRED EMBODIMENTS

Figure 1:
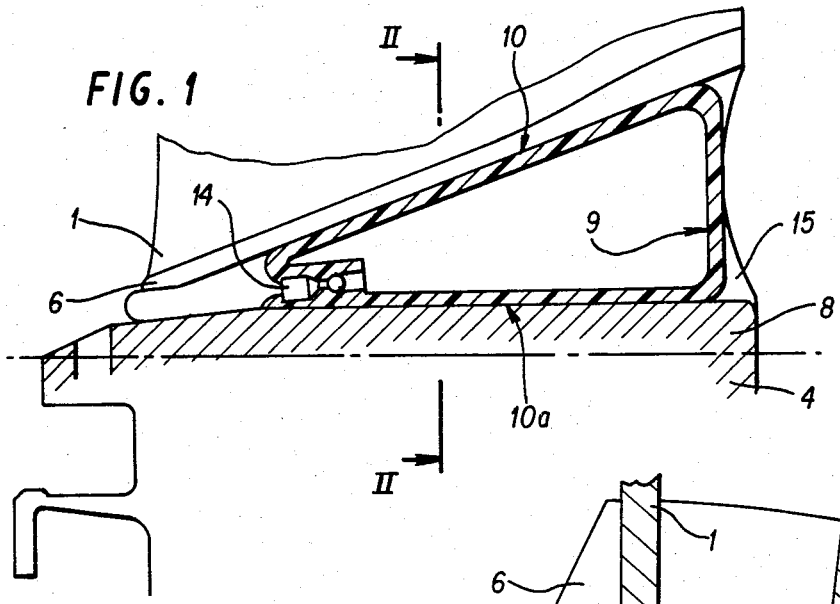
FIG. 1 is a radial cross-sectional view of a fan blade fitted with the shock-absorbing system according to the invention.
Figure 2:
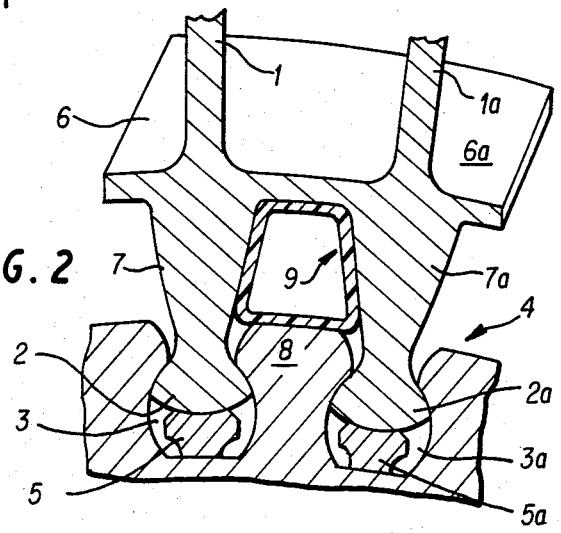
FIG. 2 is a cross-sectional view taken along line II—II in FIG. 1.

In FIGS. 1 and 2, two consecutive blades 1 and 1*a* of a fan are shown in which the roots 2, 2*a* are placed in grooves 3, 3*a* of a disc 4, with the interposition of rigid block 5, 5*a*. In the prismatic space 15 delimited by two half-platforms 6, 6*a* of the blades 1, 1*a*, the shanks 7, 7*a* of the blades and the top of a tooth 8 of the disc 4 between these two blades, is positioned an inflatable wedge 9.

Figure 3:
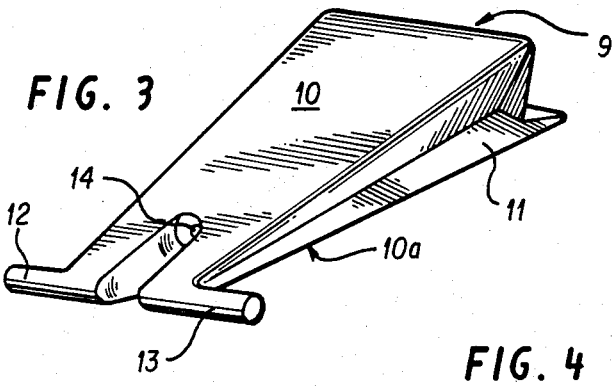
FIG. 3 is a perspective view of a block according to the invention in the deflated position.
Figure 4:
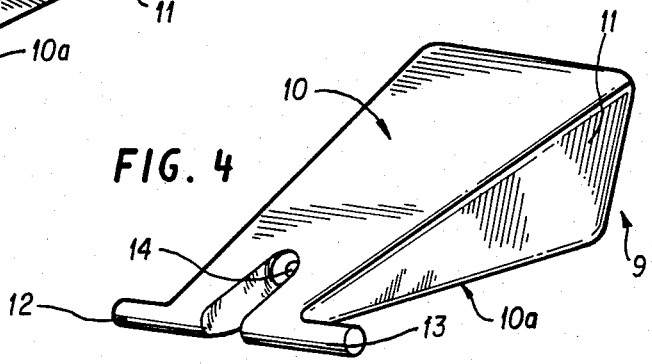
FIG. 4 is a perspective view of a chock according to the invention in the inflated position.

The wedge 9 shown in FIGS. 3 and 4 consists of a hollow, inflatable body having two plane sides, one side 10*a* of which is supported on the ends of the disc teeth 4 and the other side 10 supported on the two half-platforms 6,6*a* of the neighboring blades 1, 1*a*, these sides being connected to one another by a folding wall 11 giving the inflatable wedge 9 the form of a bellows. The material employed for the inflatable wedge 9 may be of a flexible elastomeric material with considerable elongation, preferably reinforced.

A stop mechanism is further provided to limit axial movement of the wedge 9. In the example shown, the wedge 9 has in the front portion thereof two arms 12, 13 which rest on the front face of the shanks 7, 7*a* and prevent the wedge 9 from axially moving. Arms 12, 13, as shown in the Figures, are interconnected on an upstream side of the blades.

Between the two arms 12, 13, a cavity is provided in the front portion of the wedge 9 and in which is placed a valve 14 allowing to inflate said wedge 9. If the disc 4 or the blades 1, 1*a* are provided with a rear mechanical stop mechanism, then the mechanism for axially stopping the pneumatic wedge 9 then consists of this mechanical stop. In this case, the arms 12 and 13 can be eliminated (while obviously keeping the valve).

In the example shown, the wedge 9 is introduced from front to back into the space 15 in its flattened form shown in FIG. 3. The wedge 9 is then inflated to present the appearance shown in FIG. 4. The inflation pressure may be on the order of 5 bars, for example.

The wedge 9 then occupies all the prismatic space 15 located below the platforms 6, 6*a* of the blades, and the wedge 9 pushes the platforms 6, 6*a* radially upwardly. In addition, expansion of the wedge 9 peripherally contributes to holding the blades 1, 1*a* firmly in place and to absorbing vibrations.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A damping device for turbojet engine fan blades, each of said blades having a blade root portion, a half-platform and a shank interconnecting said root portion and said half-platform, comprising:

a disc having a rim portion formed of a plurality of teeth delimiting axial grooves which receive said root portion of each of said blades, each of said blade root portions being extended radially by said shank connected to said half-platform and wherein each half-platform extends circumferentially on either side of said shank and wherein the half-platforms and the shank of two adjacent blades and each tooth of the disc form a space between said two adjacent blades; and a wedge member mounted in said space and which further comprises a hollow, bellows-shaped body and means operatively associated with said wedge member for limiting axial movement of said wedge member, said body being inflated after mounting such that said body entirely occupies said space wherein said wedge member further comprises a first and second side which are interconnected on an upstream side of said blades wherein said first side is supported on end portions of the disc teeth and said second side is supported on said half-platforms of said adjacent blades and a folding wall interconnecting said first and second sides.

2. A damping device for turbojet engine fan blades, each of said blades having a blade root portion, a half-platform and a shank interconnecting said root portion and said half-platform, comprising:

a disc having a rim portion formed of a plurality of teeth delimiting axial grooves which receive said root portion of each of said blades, each of said blade root portions being extended radially by said shank connected to said half-platform and wherein each half-platform extends circumferentially on either side of said shank and wherein the half-platforms and the shank of two adjacent blades and each tooth of the disc form a space between said two adjacent blades; and a wedge member mounted in said space and which further comprises a hollow, bellows-shaped body and means operatively associated with said wedge member for limiting axial movement of said wedge member, said body being inflated after mounting such that said body entirely occupies said space wherein said means for stopping axial movement of said wedge member further comprises a first and second arm extending therefrom supported on a front face portion of said shank of each of said adjacent blades, respectively.

3. A system according to claim 2, wherein a front portion of said wedge has a cavity formed therein between said first and second arms and wherein said wedge further comprises an inflation valve mounted on said wedge within said cavity formed between the first and second arms.

4. A system according to claim 1, wherein said wedge further comprises a wedge of flexible, reinforced elastomeric material.

* * * * *